US005172525A

United States Patent [19]

Cook

[11] Patent Number: 5,172,525

[45] Date of Patent: Dec. 22, 1992

[54] FOLDING AND TELESCOPING SPORTS SHELTER

[76] Inventor: John S. Cook, 18944 Warwick, Birmingham, Mich. 48009

[21] Appl. No.: 809,582

[22] Filed: Dec. 17, 1991

[51] Int. Cl.[5] ..... E04B 1/346; E04H 15/00

[52] U.S. Cl. ..... 52/71; 135/901

[58] Field of Search ..... 52/71, 67, 79.5, DIG. 14; 135/111, 107, 108, 95, 900, 902; 160/218, 220, 229, 135, 351; 446/69, 71, 73, 75, 76, 80

[56] References Cited

U.S. PATENT DOCUMENTS

| | | | |
|---|---|---|---|
| 1,141,036 | 5/1915 | Burdick | 52/71 |
| 1,647,733 | 11/1927 | Keichline | 52/236.1 |
| 2,837,777 | 6/1958 | White . | |
| 2,980,124 | 4/1961 | Atchison . | |
| 3,017,194 | 1/1962 | Anderson . | |
| 3,157,185 | 11/1964 | Schoenike | 135/901 |
| 3,173,436 | 3/1965 | Peters | 52/71 |
| 3,690,334 | 9/1972 | Miller . | |
| 3,709,237 | 1/1973 | Smith . | |
| 3,854,746 | 12/1974 | Flynn et al. . | |
| 4,067,346 | 1/1978 | Husted . | |
| 4,523,418 | 6/1985 | McLaughlin | 52/582 |
| 4,974,265 | 12/1990 | Maggio . | |

*Primary Examiner*—Richard E. Chilcot, Jr.
*Assistant Examiner*—Beth A. Aubrey
*Attorney, Agent, or Firm*—Peter D. Keefe

[57] ABSTRACT

A portable shelter which is very easily carried, unfolded, assembled, disassembled and folded, and which, in the unfolded configuration, forms a sled for transporting items. The shelter is composed of a lower wall component and an upper wall component, each of which being constructed of a light, rigid material such as corrugated plastic or paper. The lower wall component is nested within the upper wall component, and both wall components have a plurality of fold locations so that they are mutually foldable into a rectangular shape suitable for use as a sled. A lid component is also foldable so as to be placeable within the folds of the two wall components. In operation, a user simultaneously unfolds the upper and lower wall components so as to provide an area for occupation therewithin. Then the user grabs the upper wall component and raises it in relation to the lower wall component until tabs on the bottom edge of the upper wall component interlock onto the top edge of the lower wall component. The lid component is then unfolded, formed, and placed upon the top edge of the upper wall component.

18 Claims, 3 Drawing Sheets

FIG.10
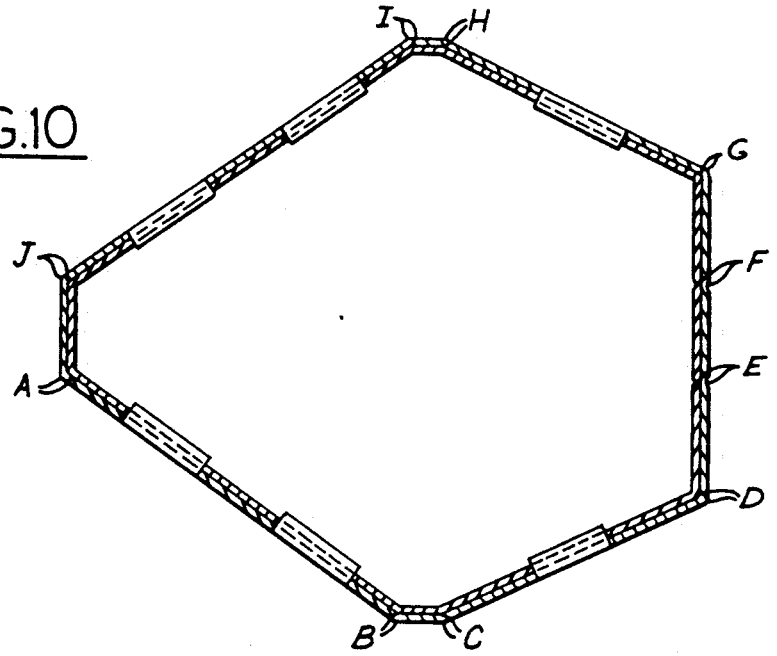
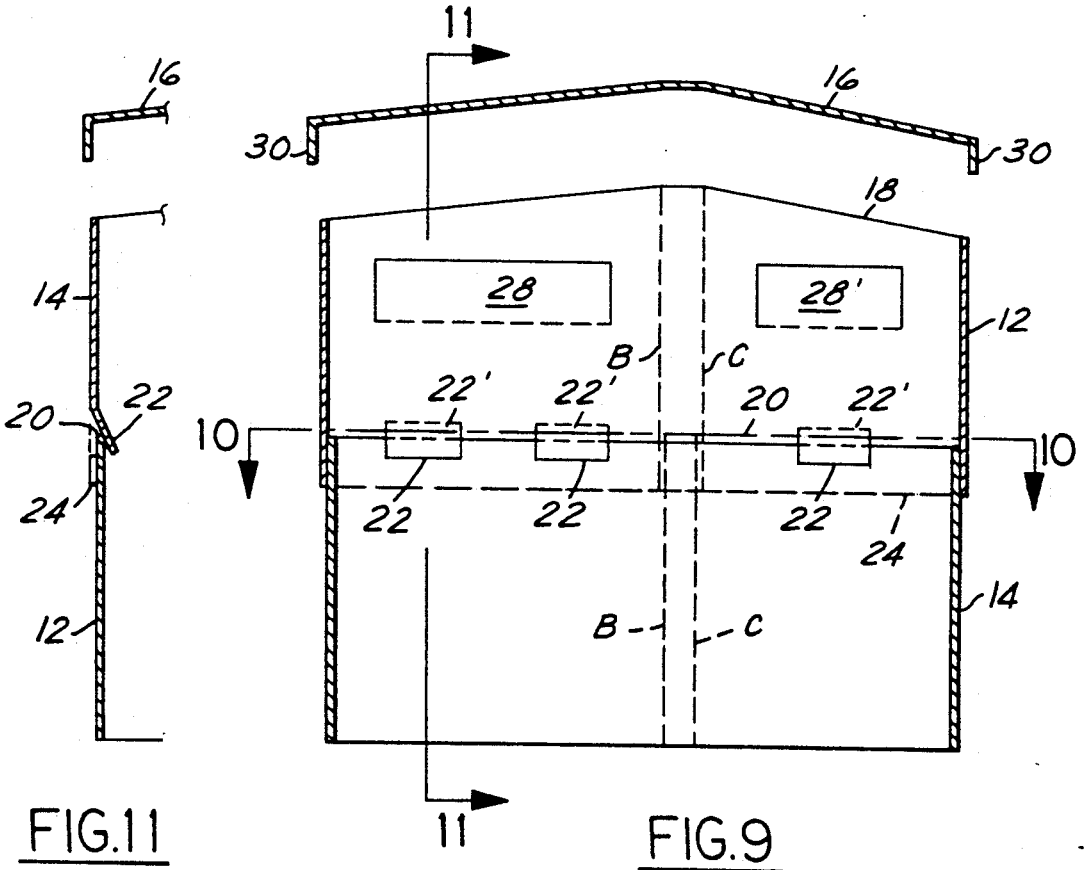
FIG.11
FIG.9
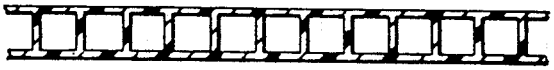
FIG.12

FOLDING AND TELESCOPING SPORTS SHELTER

BACKGROUND OF THE INVENTION

1. Field of The Invention

The present invention relates to portable, collapsible hunting blinds, ice-fishing shanties, and the like. More particularly, the present invention relates to a sports shelter which features wall components which are foldable and which telescopically interconnect for providing easy assembly and disassembly, as well as for providing, when in a folded configuration, a sled for transportation of items and game animals.

2. Description of the Prior Art

Hunters frequently utilize blinds which provide shelter from the elements as well a camouflage with respect to game animals. These blinds generally feature four walls, a door, a roof, and windows through which the hunter may observe and shoot game. Ice-fishermen frequently utilize a shanty above their ice holes, the shanty having four walls, a door and a roof. Materials utilized in the construction of stationary sports shelters are frequently wood, plywood and other common building materials. Where portability is an issue, lighter materials are utilized.

In the prior art there are a number of different kinds of portable sports shelters. U.S. Pat. No. 3,854,746, dated Dec. 17, 1974, discloses a foldable shanty made of foamed plastic panels with fabric hinges. U.S. Pat. No. 2,837,777 to White, dated Jun. 10, 1958, discloses a duck blind constructed of selectively folded corrugated paperboard. U.S. Pat. No. 3,017,194 to Anderson, dated Jan. 16, 1962, discloses a collapsible shelter constructed of hinged panels which unfold into a shelter and fold into a toboggan. U.S. Pat. No. 3,709,237 to Smith, dated Jan. 9, 1973, discloses upper and lower courses of rigid hinged sections, the courses are hinged together; the courses and sections unfold to form a partial enclosure and fold together for transportation. U.S. Pat. No. 2,980,124 to Atchison, dated Jan. 6, 1960, discloses a portable shelter constructed of wooden frame members and canvass. U.S. Pat. No. 4,067,346 to Husted, discloses a hunting blind constructed of foldable corner and strut members which are covered by a painted fabric. U.S. Pat. No. 3,690,334 to Miller, dated Sep. 12, 1972, discloses a hunting blind constructed of a plurality of foldable poles covered by a plastic. Finally, U.S. Pat. No. 4,974,265 to Maggio, dated Dec. 4, 1990, discloses a portable privacy shelter having a plurality of coaxially disposed wall sections which mutually telescope, and which are held in the extended position by friction.

While a wide variety of portable sports shelters are known in the prior art, there remains the need for a portable shelter which is very easily carried, unfolded, assembled, disassembled and folded, and which, in the folded configuration, forms a sled for transporting gear and game animals.

SUMMARY OF THE INVENTION

The present invention is a portable shelter which is very easily carried, unfolded, assembled, disassembled, and folded, and which, in the unfolded configuration, forms a sled for transporting items.

The shelter according to the present invention is composed of a lower wall component and an upper wall component, each of which being constructed of a light, rigid material such as corrugated plastic or paper. The lower wall component is nested within the upper wall component, and both wall components have a plurality of fold locations so that they are mutually foldable into a rectangular shape suitable for use as a sled. A lid component is also foldable so as to be placeable within the folds of the two wall components.

In operation, a user simultaneously unfolds the upper and lower wall components so as to provide an area for occupation therewithin. Then the user grabs the upper wall component and raises it in relation to the lower wall component until tabs on the bottom edge of the upper wall component interlock onto the top edge of the lower wall component. The lid component is then unfolded, formed, and placed upon the top edge of the upper wall component.

Accordingly, it is an object of the present invention to provide a sports shelter which is light, compact, easily unfolded and assembled, and easily disassembled and folded.

It is another object of the present invention to provide a sports shelter which is light, compact, which features foldable and telescopically nested wall components, the features combining to provide ease of assembly and disassembly.

It is another object of the present invention to provide a sports shelter which is light, compact, which features foldable and telescopically nested wall components for providing a sled when in a folded configuration.

These, and additional objects, advantages, features and benefits of the present invention will become apparent from the following specification.

BRIEF DESCRIPTION OF THE DRAWINGS

FIG. 9 is an exploded side view of the shelter according to the present invention shown in an exploded assembled configuration.

FIG. 10 is a sectional top plan view of the shelter according to the present invention, seen along lines 10—10 in FIG. 9.

FIG. 11 is an exploded sectional side view of the shelter according to the present invention, seen along lines 11—11 in FIG. 9.

FIG. 12 is a sectional plan detail view of any one of the upper and lower wall components.

DETAILED DESCRIPTION OF THE PREFERRED EMBODIMENT

Figure 1:
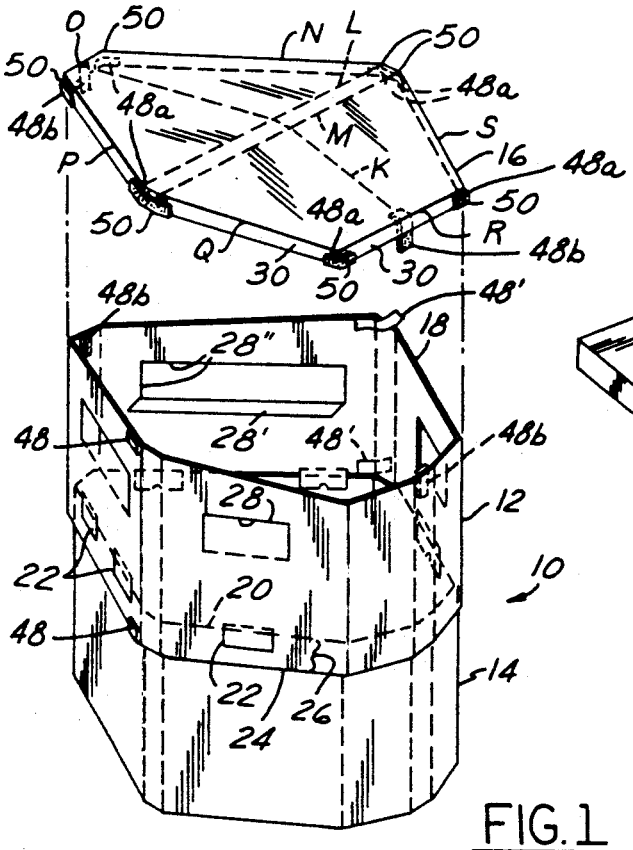
FIG. 1 is a partly exploded perspective view of the shelter according to the present invention.

Referring now to the Drawing, FIG. 1 shows a perspective view of the shelter 10 according to the present invention. The shelter 10 is generally composed of three components: a multiply sided closed loop upper wall component 12, a multiply sided closed loop lower wall component 14 that is telescopically nested within the upper wall component, and a lid component 16 which connects to the top edge 18 of the upper wall component. It will be seen from FIG. 1 that the operational configuration of the shelter 10 involves the upper wall component 12 being telescopically raised in relation to the lower wall component 14, with the upper wall component being held thereat by a plurality of tabs 22 resting upon the top edge 20 of the lower wall component. It is preferred for the tabs 22 to be located substantially adjacent the lower edge 24 of the upper wall component so that a wall overlap 26 is provided with respect to the upper and lower wall components 12, 14 in order to provide wall stability to the shelter 10. Openings 28 are provided in the upper wall component which serve as windows for the user by selectively folding a flap 28' formed by cuts 28" on three sides of the openings 28. The lid component 16 has edge flanges 30 which serve to interface with the top edge 18 of the upper wall component so as to retain the shelter 10 in a predetermined operational shape, as shown in FIG. 1.

Figure 2:
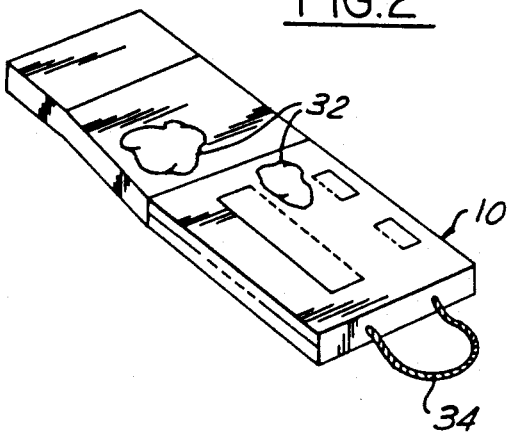
FIG. 2 is a side view of the shelter according to the present invention shown in a folded configuration for being used as a sled.

It is preferred to construct the upper and lower wall components 12, 14 and the lid component 16 from light, rigid plastic corrugated panels; other durable and weather resistant panel materials are acceptable, such as wax coated corrugated paperboard. A feature of the shelter 10 is for the upper and lower wall components to be foldable into a thin, rectangular shape and for the lid component to be foldable into a shape suitable for being fit into the thin, rectangular shape formed by the folded upper and lower wall components. Thus, the shelter 10 when so folded and laid on one side as shown in FIG. 2, can serve as a sled for transporting items 32. To provide this feature, the upper wall component 12, lower wall component 14 and the lid component 16 are provided with fold locations, preferably demarcated by scoring in the event that corrugated panel materials are used in construction of the shelter 10.

Figure 3:
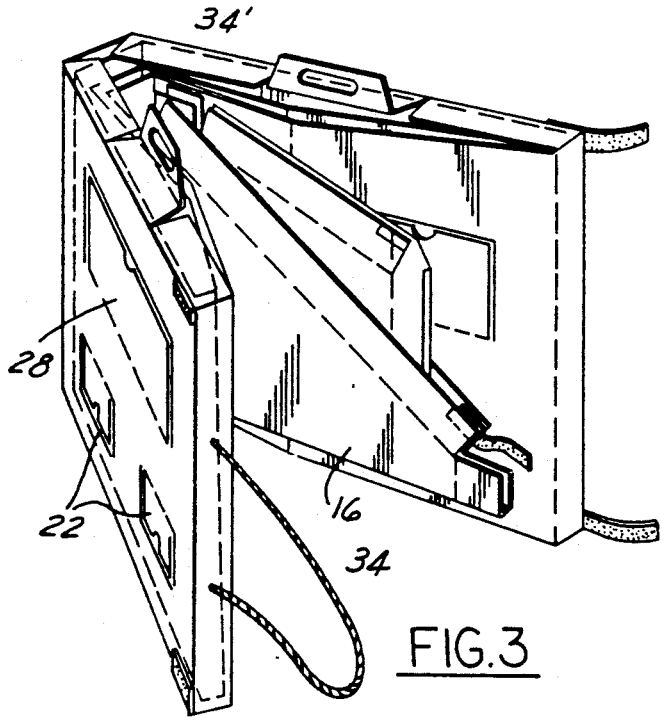
FIG. 3 is a perspective view of the shelter according to the present invention in substantially the fully folded configuration.
Figure 4:
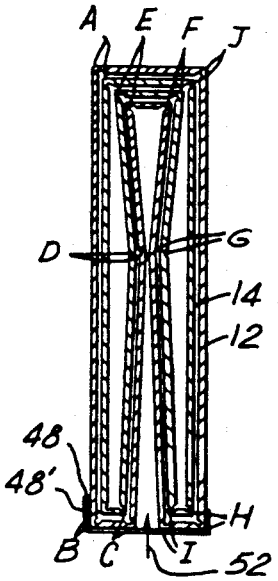
FIG. 4 is a top plan view of the shelter according to the present invention showing the wall components in substantially the fully folded configuration.
Figure 5:
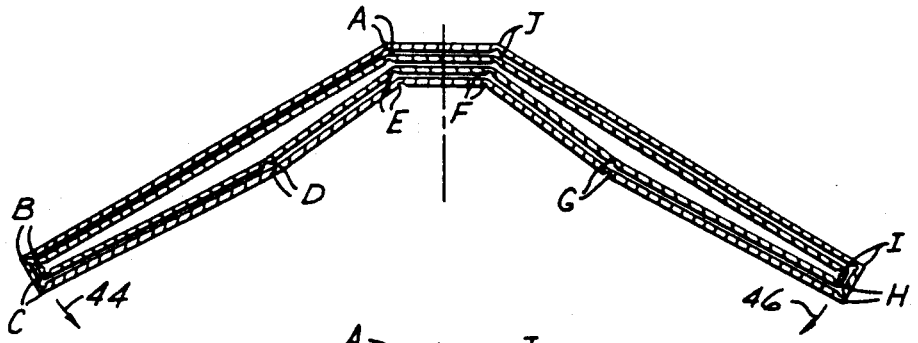
FIG. 5 is a top plan view of the shelter according to the present invention showing the wall components in a first intermediate folded configuration.
Figure 6:
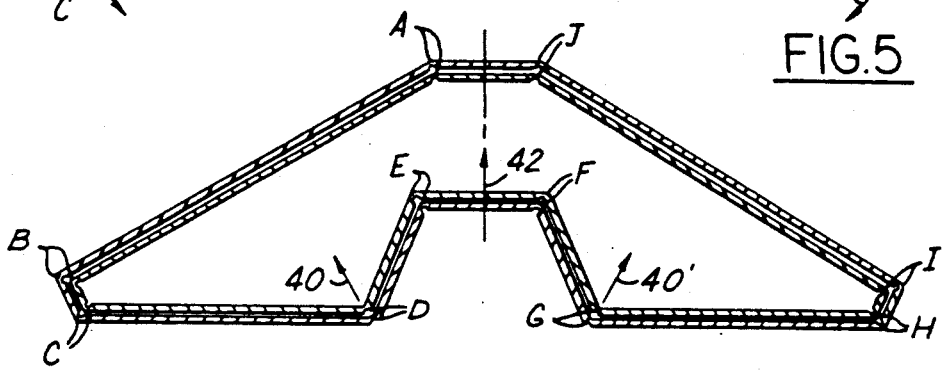
FIG. 6 is a top plan view of the shelter according to the present invention showing the wall components in a second intermediate folded configuration.

As can be understood from reference to FIGS. 2, 3 and 4, the shelter 10 is compactly foldable into a thin, rectangular shape. In a folded shape, as shown in FIG. 2, the shelter 10 is usable as a sled for slidably transporting items 32, such as gear or game animals, across the ground via a rope 34 connected with the upper wall component 12. The shelter 10 can be folded still further into its fully folded shape in which the shelter 10 may be carried like a briefcase via handle 34', as substantially shown in FIG. 3.

Figure 7:
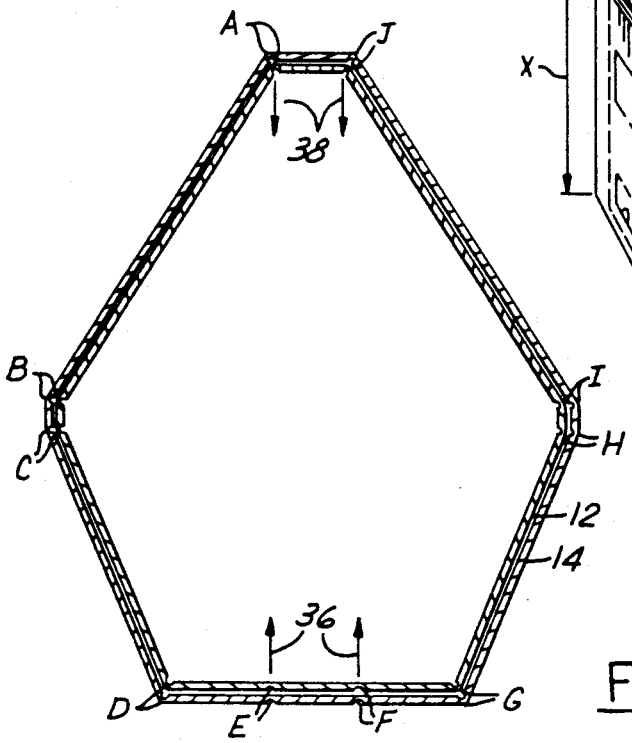
FIG. 7 is a top plan view of the shelter according to the present invention showing the wall components in the fully unfolded configuration.
Figure 8:
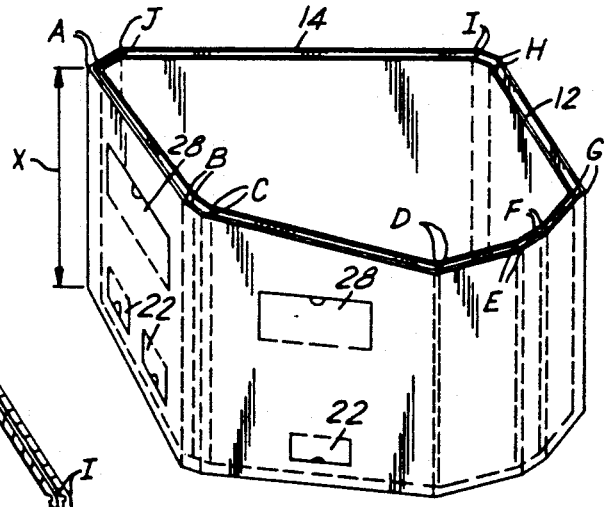
FIG. 8 is a perspective view of the shelter according to the present invention showing the wall components in the fully unfolded configuration.

As can be discerned by reference to FIGS. 7 and 8, the lower wall component 14 is nested coaxially within and adjacent the upper wall component 12. The height x of each of the upper and lower wall components is preferably the same, 2x being preferably, but not necessarily, on the order of about 60 inches. It will be seen most clearly in FIG. 7 that each of the upper and lower wall components 12, 14 are provided with ten fold locations A through J. The fold locations are set at predetermined positions on the upper and lower wall components so that they will mutually fold into the thin, rectangular shape shown in FIGS. 2, 3 and 4, as detailed hereinbelow. As shown in FIGS. 7 and 8, the upper and lower wall components 12, 14 are fully unfolded into a shape which provides substantially a maximum of space therewithin for occupation by one or more users.

As can be understood by successive reference to FIGS. 7, 6, 5, and 4 the simultaneous folding of the upper and lower wall components 12, 14 proceeds as follows. Starting with the unfolded configuration of FIG. 7, fold locations E and F are moved along arrows 36, and fold locations A and J are moved along arrows 38 so as to arrive at the configuration shown in FIG. 6. Now, fold location D is moved along arrow 40, fold location G is moved along arrow G', and the portion of the upper and lower wall components situated between fold locations E and F is moved along arrow 42 so as to arrive at the configuration shown in FIG. 5. Now, fold location C is moved along arrow 44, and fold location H is moved along arrow 46 so as to arrive at the desired final configuration shown in FIG. 4. A strap 48' having a releasable fastener 48, such as a hook and loop fastener is used to secure the shelter in the fully folded configuration of FIG. 4.

Further with respect to folding the shelter 10, the lid component 16 shown unfolded in FIG. 1, is folded along fold locations L through S in order to arrive at the configuration shown in FIG. 3. In this regard, the edge flange corners 50 are each provided with a releasable fastener 48*a* so as to permit forming of the lid component 16 and yet permit folding along fold locations N through S. The lid component 16 in its fully folded configuration is placed into the folded upper and lower walls 12, 14 along arrow 52 in FIG. 4 so as to achieve the storage placement shown in FIG. 3.

Unfolding of the shelter 10 from the folded configuration shown FIGS. 2, 3 and 4 to the unfolded configuration shown in FIGS. 7 and 8, a reversal of the foregoing steps is performed by the user.

Referring now to FIGS. 8 through 11 final assembly of the shelter 10 will be described, starting with the unfolded configuration shown in FIGS. 7 and 8.

The user steps into the space defined by the upper and lower wall components 12, 14. Then user grabs hold of the upper wall component 14 and thereupon lifts it in relation to the lower wall component 12. The tabs 22 include a fold location 22' which biases the tabs toward the lower wall component. When the tabs 22 clear the top edge 20 of the lower wall component 14, the tabs move over the top edge 20. Now, the user slowly lowers the upper wall component 12 relative to the lower wall component 14 until the tabs 22 are restingly trapped on the top edge 20 of the lower wall component with an predetermined overlap 26 between the upper and lower wall components being provided, as shown with particularity in FIGS. 9, 10 and 11. The lid component 16 is now unfolded and formed by securing the edge flange corner releasable fasteners 48*a* at each of the edge flange corners 50, as shown generally in FIG. 1. The lid component 16 is now placed onto the top edge 18 of the upper wall component 12 and held securely thereto by a releasable fastener on a strap 48*b* that is in turn connected with the top edge 18, thereby completing erection of the shelter 10. Finally the windows are provided as desired by movement of the flaps 28'. To disassemble the shelter 10 involves a reversal of the aforesaid steps.

To those skilled in the art to which this invention appertains, the above described preferred embodiment may be subject to change or modification. For instance, while the present invention has been described herein as a sportsman's shelter, this is by way of the preferred example of use; many other uses are possible, such as a child's playhouse. Further, the shelter need not necessarily be foldable. Such change or modification can be carried out without departing from the scope of the invention, which is intended to be limited only by the scope of the appended claims.

What is claimed is:

1. A portable shelter, comprising:

an upper wall component having a top edge and a bottom edge, said upper wall component being formed of a multiply sided closed loop defined by a plurality of first folds, said upper wall component being foldable between a predetermined folded configuration and a predetermined unfolded configuration;

a lower wall component having a top edge and a bottom edge, said lower wall component being formed of a multiply sided closed loop defined by a plurality of second folds, said lower wall component being foldable between said predetermined folded configuration and said predetermined unfolded configuration, said lower wall component being coaxially located within and adjacent said upper wall component, each of said first folds of said upper wall component being adjacent said second folds of said lower wall component so that said upper wall component and said second wall component may be simultaneously foldable along said first and second folds, said upper wall component being telescopically movable in relation to said lower wall component;

holding means connected with said upper wall component for resting said upper wall component upon said top edge of said lower wall component when said upper wall component is telescopically raised in relation to said lower wall component; and a lid component structured for being connected with said top edge of said upper wall component.

2. The portable shelter of claim 2, wherein said top component further comprises a plurality of edge flanges for interfacing with said upper wall component, said lid component having a plurality of third folds for being selectively foldable into a predetermined configuration for being storable within said upper and lower wall components when said upper and lower wall components are in said predetermined folded configuration.

3. The portable shelter of claim 3, wherein said holding means comprises a plurality of tabs connected with said upper wall component which are each foldably movable so as to restingly engage said top edge of said lower wall component.

4. The portable shelter of claim 3, wherein said predetermined folded configuration is substantially rectangular.

5. The portable shelter of claim 4, further comprising rope means connected with said upper wall component; wherein said plurality of first folds of said upper wall component and said plurality of second folds of said lower wall component are located so that the upper and lower wall components are simultaneously foldable into a substantially rectangular sled for transporting items across terrain.

6. The portable shelter of claim 4, further comprising handle means connected with said upper wall component and releasable fastener means connected with said upper wall component; wherein said plurality of first folds of said upper wall component and said plurality of second folds of said lower wall component are located so that the upper and lower wall components are simultaneously foldable into a substantially rectangular briefcase-like configuration which is retained by said releasable fastener means.

7. The portable shelter of claim 3, further comprising at least one window means connected with said upper component for selectively providing a window in said upper wall component.

8. The portable shelter of claim 3, wherein said upper wall component, said lower wall component and said lid component are each constructed of a semi-rigid corrugated material.

9. The portable shelter of claim 8, wherein said corrugated material is a plastic.

10. The portable shelter of claim 3, wherein said plurality of first folds of said upper wall component comprises ten folds; and wherein said plurality of second folds of said lower wall component comprises ten folds.

11. The portable shelter of claim 10, wherein said upper and lower wall components form an eight sided structure when in said predetermined unfolded configuration.

12. The portable shelter of claim 11, wherein said eight sided structure is composed of five sides which are each substantially longer than the other three sides, and one of the sides has two folds of each of said first and second folds.

13. The portable structure of claim 3, wherein said edge flanges of said lid component further comprises corners structured for being reversibly formed by a releasable fastener connected to said edge flanges.

14. The portable structure of claim 13, further comprising fastener means connected with said lid component and said upper wall component for releasably securing said lid component to said upper wall component.

15. A portable shelter, comprising:

an upper wall component having a top edge and a bottom edge, said upper wall component being formed of a multiply sided closed loop defined by a plurality of first folds, said upper wall component being foldable between a predetermined folded configuration and a predetermined unfolded configuration;

a lower wall component having a top edge and a bottom edge, said lower wall component being formed of a multiply sided closed loop defined by a plurality of second folds, said lower wall component being foldable between said predetermined folded configuration and said predetermined unfolded configuration, said lower wall component being coaxially located within and adjacent said upper wall component, each of said first folds of said upper wall component being adjacent said second folds of said lower wall component so that said upper wall component and said second wall component may be simultaneously foldable along said first and second folds, said upper wall component being telescopically movable in relation to said lower wall component;

a plurality of tabs connected with said upper wall component which are each foldably movable so as to restingly engage said top edge of said lower wall component for resting said upper wall component upon said top edge of said lower wall component when said upper wall component is telescopically raised in relation to said lower wall component; and a lid component structured for being connected with said top edge of said upper wall component, said top component having a plurality of edge flanges for interfacing with said upper wall component, said lid component having a plurality of third folds for being selectively foldable into a predetermined configuration for being storable within said upper and lower wall components when said upper and lower wall components are in said predetermined folded configuration;

wherein said upper wall component, said lower wall component and said lid component are each constructed of a semi-rigid corrugated material.

16. A portable shelter, comprising:

an upper wall component having a top edge and a bottom edge, said upper wall component being formed of a closed loop;

a lower wall component having a top edge and a bottom edge, said lower wall component being formed of a closed loop, said lower wall component being coaxially located within and adjacent said upper wall component, said upper wall component being telescopically movable in relation to said lower wall component;

a plurality of tabs connected with said upper wall component which are each foldably movable so as to restingly engage said top edge of said lower wall component for resting said upper wall component upon said top edge of said lower wall component when said upper wall component is telescopically raised in relation to said lower wall component; and a lid component structured for being connected with said top edge of said upper wall component.

17. The portable shelter of claim 16, wherein said lid component has a plurality of edge flanges for interfacing with said upper wall component.

18. The portable structure of claim 17, wherein said upper wall component, said lower wall component and said lid component are each constructed of a semi-rigid corrugated material.

* * * * *